US006412655B1

(12) United States Patent
Stuetzel et al.

(10) Patent No.: US 6,412,655 B1
(45) Date of Patent: Jul. 2, 2002

(54) TOWEL DISPENSER

(75) Inventors: Michael Stuetzel; Andreas Heub-Schneider, both of Idar-Oberstein (DE)

(73) Assignee: Wilhelm Blatz, Bruchkobel (DE)

( * ) Notice: Subject to any disclaimer, the term of this patent is extended or adjusted under 35 U.S.C. 154(b) by 0 days.

(21) Appl. No.: 09/462,081

(22) PCT Filed: May 12, 1999

(86) PCT No.: PCT/EP99/03277

§ 371 (c)(1),
(2), (4) Date: Mar. 28, 2000

(87) PCT Pub. No.: WO99/58040

PCT Pub. Date: Nov. 18, 1999

(30) Foreign Application Priority Data

May 12, 1998 (DE) ..... 198 20 978

(51) Int. Cl.[7] ..... B65H 19/00

(52) U.S. Cl. ..... 221/13; 226/127; 226/129; 242/563.2; 242/564.4; 242/598.6; 225/10; 225/106; 221/30

(58) Field of Search ..... 221/13, 30; 250/221; 340/562, 573; 242/55.2, 55.553, 55.3, 563.2, 564.4, 598.6; 226/127, 128, 129, 130, 131, 132, 133; 225/10, 11, 106

(56) References Cited

U.S. PATENT DOCUMENTS 4,122,708 A * 10/1978 Maier ..... 73/136
4,192,442 A * 3/1980 Bastian et al. ..... 226/127
4,317,547 A * 3/1982 Graham, Jr. et al. ..... 242/560.1
4,406,421 A 9/1983 Schultz et al.
4,666,099 A * 5/1987 Hoffman et al. ..... 242/55.53
4,690,344 A * 9/1987 Yokota ..... 225/10
5,212,621 A * 5/1993 Panter ..... 361/181
5,452,832 A * 9/1995 Niada ..... 225/11
5,467,022 A * 11/1995 Aoki et al. ..... 324/661
5,663,633 A * 9/1997 Kahn et al. ..... 323/218
5,772,291 A * 6/1998 Byrd et al. ..... 312/34.22
5,808,552 A * 9/1998 Wiley et al. ..... 340/573
5,933,288 A * 8/1999 Plesko ..... 359/896

FOREIGN PATENT DOCUMENTS

DE 3400575 7/1985
WO WO93/08356 * 4/1993

* cited by examiner

*Primary Examiner*—Christopher P. Ellis
*Assistant Examiner*—Patrick Mackey
(74) *Attorney, Agent, or Firm*—Dennison, Schultz & Dougherty

(57) ABSTRACT

The invention relates to a towel dispenser (10) such as a paper towel dispenser comprising a housing (12) in which a paper roll and an issuing device (50) are arranged. Said issuing device can AC be controlled by a sensor (38). In order to simplify the operation and to increase the reliability of the towel dispenser, the invention provides that the sensor (38) is configured as a capacitive sensor.

15 Claims, 4 Drawing Sheets

TOWEL DISPENSER

BACKGROUND OF THE INVENTION

The invention relates to a towel dispenser, in particular a paper towel dispenser, comprising a housing in which a receiver such as a roller for the towel or several towels and an issuing device for said towel(s) is provided, with the issuing device being actuatable by a sensor activatable from the housing exterior. The invention further relates to a towel dispenser, in particular a paper towel dispenser, comprising a housing in which on the one hand the dispensed product, such as a paper roll, and on the other hand an issuing device are arranged.

Towel dispensers, in particular paper towel dispensers, whose issuing device reacts to a light-sensitive sensor are known. To prevent the sensor from reacting to light changes as caused by persons walking past, for example, the sensor in the known dispensing devices must be arranged on a lateral housing panel so that defined light conditions are assured. This however entails the drawback that persons wishing to operate the towel dispenser only find the laterally arranged sensor after a lengthy search. Also, these types of dispensing devices are often arranged with insufficient clearance from side walls, so that the amount of light is insufficient to dependably trigger operation.

A paper towel dispenser is described in U.S. Pat. No. 4,406,421. From its housing exterior, a lever is accessible via which rack and pinion inside the housing mesh such that a section of the paper towel is accessible via a issuing opening.

WO97/29671 describes an electrically actuatable paper towel dispenser that can be actuated by means of a photographic sensor.

In order to obtain liquid soap from a dispenser, in particular in the area of operating theaters, without the need to directly touch the dispenser, a capacitive sensor is used in accordance with DE 34 00 575 A1, the one electrode of which runs directly in the area of the liquid dispensing opening. The counter-electrode is formed by the space on which the person wishing to use the dispenser is standing.

The problem underlying the present invention is to develop a dispensing device of the type mentioned at the outset such that its operation is simplified and its dependability increased.

SUMMARY OF THE INVENTION

The problem is solved in accordance with the invention substantially in that the sensor is a capacitive sensor with a first two-dimensional and a second two-dimensional electrode arranged inside the housing and passing along at least one housing panel. In particular, it is provided that the first and the second electrode run in one plane or in two planes that are parallel or approximately parallel to a housing panel, in particular to the housing front panel. The electrodes should here have diverging two-dimensional extensions, in particular in the ratio of 1:5 to 1:20, in particular 1:10. Here an electrode can have a surface area of, for example, 8 $cm^2$ and the other electrode a surface area of 0.8 $cm^2$.

In particular, it is provided that the electrodes are at a distance from one another that in its width extension is equal to or less than the narrower electrode, which can also be described as strip-like. The electrodes themselves should have in the idle state, i.e. when the only dielectric outside the housing is air, a capacitance of approximately 1 pF±0.25 pF. If the dielectric then changes because a hand approaches, the change in capacitance will trigger a signal that in its turn actuates the towel dispenser. The electrodes forming the capacitor and running in one plane or if necessary in two parallel planes, i.e. offset to one another, generate a virtually rectified field such that the capacitance is affected whenever a change is made in the dielectric distance up to approximately 30 mm from the surface of the towel dispenser housing by, for example, the approach of a hand. The capacitor formed by the electrodes running in one plane can be described as a folded-up panel-type capacitor.

The capacitive sensor generates in its surroundings an electrical field that is changed by the approach of a hand. The change is evaluated and triggers a pulse for actuating the issuing device. The dispensing device can therefore be used regardless of room-related light conditions or other environmental effects.

Also, for operating the issuing device it is only necessary for the electrical field running between the electrodes to be changed in some way to the necessary extent, for example by an approaching hand, without the need for contact with the housing at a certain spot or for the hand to remain in a certain area. Functioning is also assured in rooms in which heavy soiling or high relative humidity occurs.

In a particularly preferred embodiment, it is provided that the sensor on the housing front side is arranged directly behind a front side of the housing. The arrangement of the sensor on the front ensures easy operation of the dispensing device.

An arrangement on a different side or the alignment of one electrode each on a separate housing side is also possible, provided an effective and influencable field extends outside the housing.

In a further preferred embodiment of the dispensing device, it is provided that the front side of the housing has at least one visual element indicating a sensor field and/or a removal opening. It is provided here that the visual element on the front side of the housing is designed as at least two recesses running horizontally. The recesses are preferably designed as semicircular and relief-like grooves. It is also provided that the recesses divide the front of the housing in the ratio of the golden section.

Apart from indicating the removal opening or localizing the sensor field or sensor surface, the recesses increase the stiffness of the housing surface.

To rule out malfunctions of the dispensing device, the sensitivity of the capacitive sensor can be adjusted. For the simplest possible design of the sensor, it is proposed that it has a first and preferably two-dimensional electrode and a counter-electrode, both of which are arranged directly behind a front surface of the front side in order to generate an electrical field outside the housing.

To ensure a mains-independent operation of the dispensing device, the latter is equipped with a battery-powered drive device.

For simple maintenance and operation, a switch is arranged on the inside of the housing, using which the issuing device can be controlled when the housing is opened. Furthermore, a timer element is provided using which the operation time of the issuing device can be adjusted.

An integrated time-lag element is also provided to determine a time after which the issuing device can be operated again. As an overload protection for a motor operating the issuing device, the circuit array has an overcurrent protection.

In a mechanical embodiment of the dispensing device, a spring-loaded lever arm that can be operated from the front of the housing is provided that has a rack for operating the issuing device. The rack here follows a circular path at whose centerpoint is the rotary axis of the lever.

For the issue of paper towels in the form of paper rolls, but also in the form of single towels, it is provided that the issuing device comprises a puller roller and a pusher roller arranged opposite thereto, with the rack interacting with a gear arranged on the shaft of the puller roller. Here the gear is designed with sleeve freewheel.

In the electrical embodiment of the issuing device, a motor with an associated transmission is provided that engages in the gear arranged on the shaft of the puller roller. The motor is here controlled by the sensor-operated control unit.

In particular, with an embodiment as a paper towel dispenser, with the paper towels being rolled off a paper roll, a tear-off device is provided, the latter being arranged on the inside of the housing and not being accessible from the outside. In this the embodiment in accordance with the invention differs from the prior art, as in known devices the tear-off device is arranged on the front side of the housing, so that injuries are possible when pulling out or tearing off the paper towels.

Regardless of whether the dispensing device is operated electrically or mechanically, the housing has a number of advantages over the prior art. In a particularly preferred embodiment, it is provided that an upper side of the housing is angled about 8° from the horizontal towards the beholder, so that rolling objects such as cigarettes cannot be rested on it.

Also, an intermediate field is provided between the upper side and the front side and angled towards the mounting wall. In addition, housing vision panels are arranged on at least one side wall for observing the items being dispensed. The housing is preferably made totally of plastic.

Further details, advantages and features of the invention are shown not only in the claims and in the features they contain—singly and/or in combination—but also in the following description of preferred embodiments shown in the drawing.

DETAILED DESCRIPTION OF THE INVENTION

Figure 1:
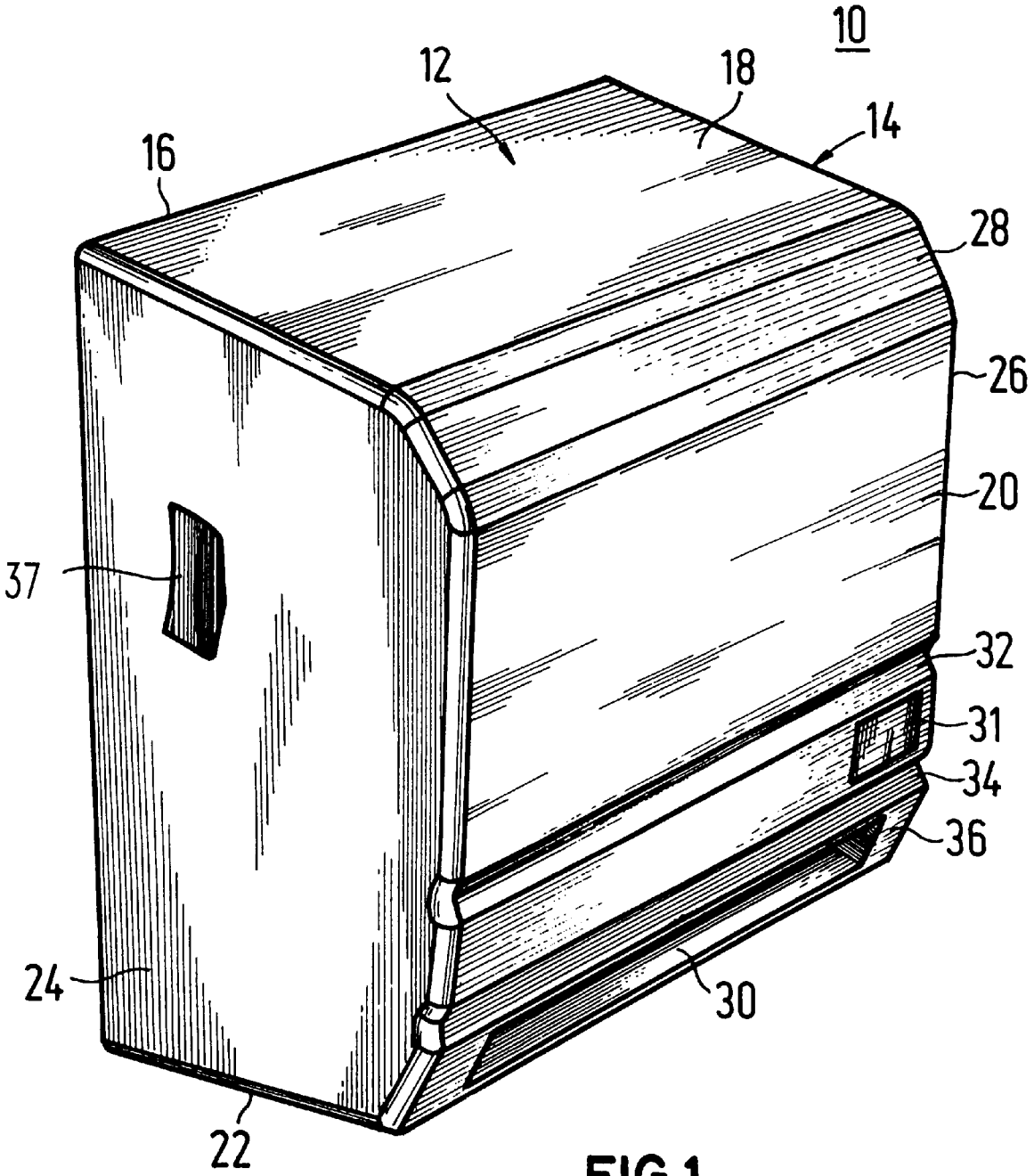
FIG. 1 shows a perspective view of a towel dispenser.

FIG. 1 shows a perspective view of a sensor-operated electrical dispensing device 10 in the form of a paper towel dispenser with integrated paper roll.

The dispensing device 10 has a housing 12 comprising a hood-like cover 14 and a rear panel 16 attachable to a mounting wall (not shown). The cover 14 is rotatably fastened to the rear panel 16.

The hood-like cover 14 comprises an upper side 18, a front side 20, a lower side 22 and side surfaces 24, 26. Overall the surface of the hood-like cover 14 is closed, smooth and glossy, with the individual sides 18, 20, 22 being at different angles relative to one another, so that a characteristic and dynamic appearance is obtained.

In particular, the upper side 18 is slightly inclined towards the beholder at an angle of preferably about 8°, so that the placing or leaving of objects such as cigarettes and other rolling objects is prevented. A transitional area 28 or intermediate field is provided between the upper side 18 and the front side 20 and is inclined towards the mounting wall so that the optical appearance of the hood-like cover 14 is matched to a removal opening 30 for towel removal arranged in the lower part of the front side 20.

The housing 12 shown in FIG. 1 is a housing for an electrically operated dispensing device with sensor activation. For visual indication of the removal opening 30 and for localization of a sensor field 31, two horizontally running recesses 32, 34 are provided in the front side 20 of the cover 14. These are semicircular and relief-like grooves which divide the dispenser housing 12 in the golden section, so that a balanced appearance is obtained. The recesses 32, 34 designed as grooves of semicircular cross-section have a radius selected such that a flawless cleaning of the housing surface is assured. In addition to the informative character of the recesses 32, 34 such as grooves, they also increase the component rigidity, in particular of the front side 20.

To prevent a direct view into the removal opening 30, a housing surface section 36 in which the removal opening 30 has been provided is also inclined towards the mounting wall (not shown).

In both side panels 24, 26 of the hood-like cover 14, vision windows 37 are provided to permit a check on how many unused towels are present in the housing 12 by means of a notional arrow shape. The vision windows are made of transparent plastic and are in two parts (erosion-type texture/without texture), with a check mark to simulate the contour of the towel supply, such as the paper roll.

The rear panel 16 is completely enclosed by the hood-like cover 14, so that it is not visible in the mounted state. An all-round rim (not shown) on a rear side of the dispenser ensures a spacing of approx. 2.5 mm from the mounting wall, so that splash water, condensation etc. can run off unhindered and not get inside the dispenser 10.

Figure 2:
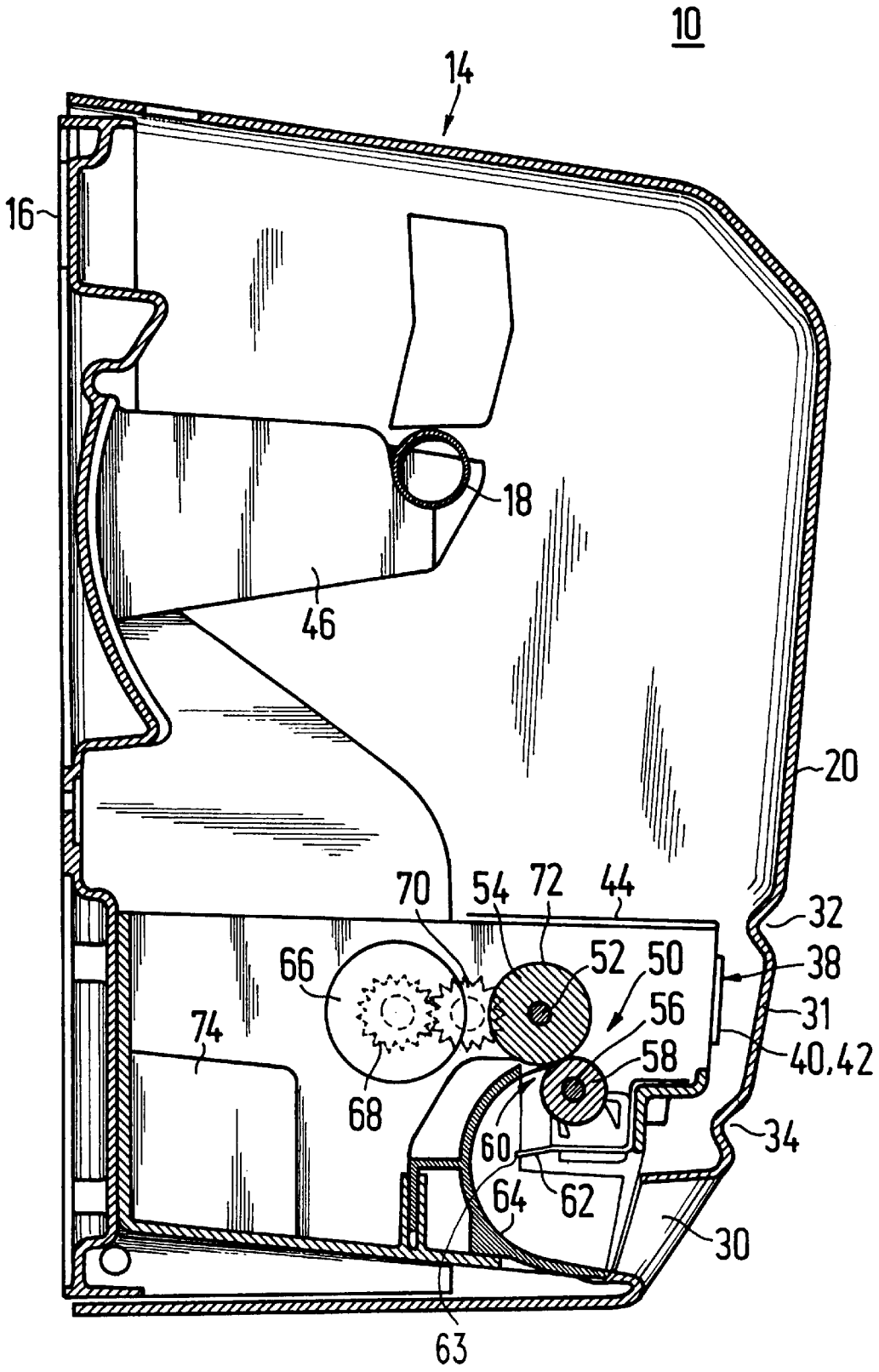
FIG. 2 shows a sectional view of the dispensing device in accordance with FIG. 1 in the electrical embodiment.

FIG. 2 shows a cross-section through the electrically operated dispensing device 10 in accordance with FIG. 1. Compared with conventional dispensing devices, the dispensing device 10 in accordance with the invention is distinguished in that it has a capacitive sensor 38, which in the embodiment is arranged directly behind the front side 20. In particular, the capacitive sensor 38 has a two-dimensional electrode 40 and a counter-electrode 42 arranged behind a sensor field 31 that is particularly emphasized by the horizontally running grooves 32 and 34 on the front side. The arrangement of the capacitive sensor 38 on the front side permits considerably more user-friendly handling compared with dispensing devices known from the prior art, since the sensor does not necessarily have to be arranged on the side.

The electrodes 40, 42 run parallel or approximately parallel to the sensor field 31 at least in some areas. The sensor field 31 can cover the entire width of the housing.

Also, the sensor field can be in the area of the abutting front and side surfaces 20, 26 of the housing 10, and in the area of an edge of the housing 10.

Figure 3:
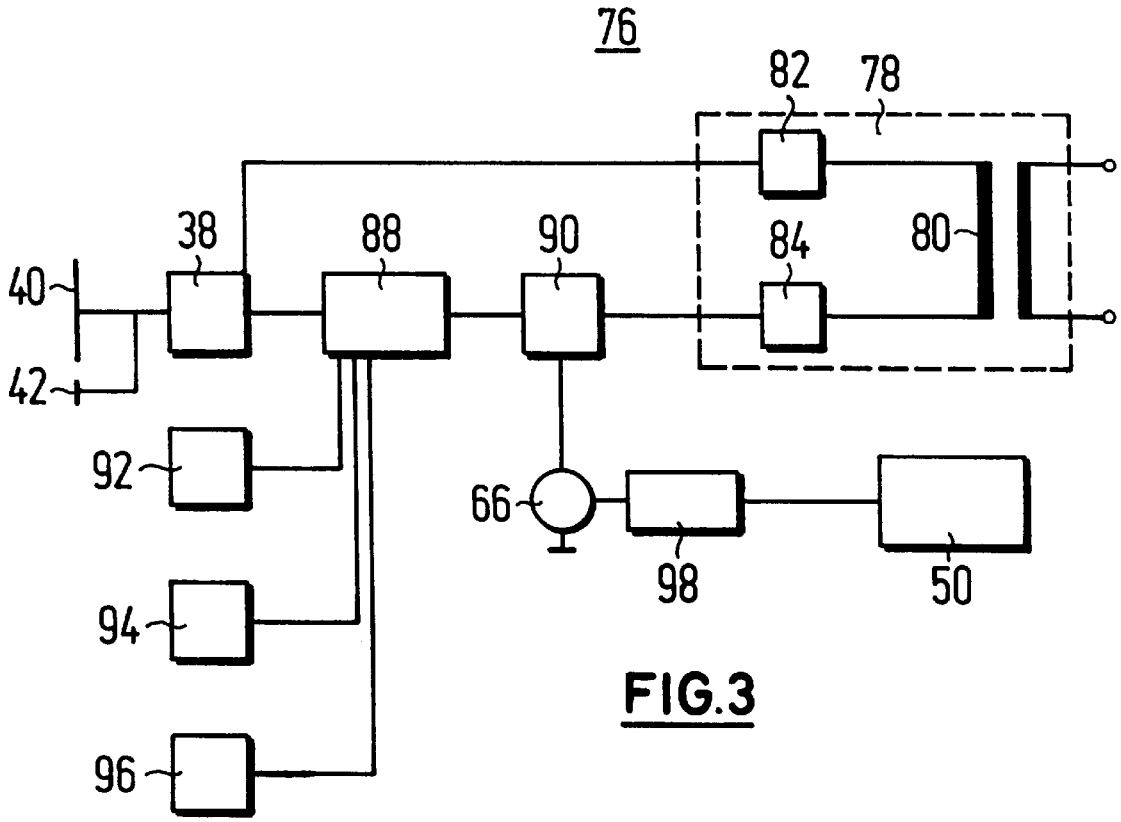
FIG. 3 shows a block diagram of a control circuit for the dispensing device in accordance with FIG. 2.

The capacitive sensor 38 is connected to an evaluation circuit arranged on a PCB 44, as described in detail for FIG. 3.

A holder 46 extending from the rear panel 16 is provided and supports a roller 48 for receiving a towel roll, in particular a paper roll (not shown). For dispensing a section of the roll from the removal opening 30, an issuing device 50 is provided.

The issuing device 50 comprises a puller roller 54 arranged on a shaft 52 and opposite which a pusher roller 58 is arranged, also on a shaft 56. In a gap 60 formed between the puller roller 54 and the pusher roller 58, a paper strip to be conveyed (not shown) is inserted, and is passed to the outside through the removal opening 30 during operation of the puller roller 54.

For separation of the paper, a cutting edge 62 is provided that in the embodiment shown here is designed as a ZFN shaped angular section of sheet metal with a toothed pattern. The teeth provided on a longitudinal edge 63 of the cutting edge are preferably designed with differing lengths.

The transported paper strip is passed along an arc-shaped guide surface 34 in the direction of the removal opening 30.

In the embodiment shown here in accordance with FIG. 2, a torque is transmitted by means of a motor 66 that can be actuated using the electric actuation device 44. The motor 66 has on the output side a gear 68 that interacts via a further gear 70 with a gear 72 arranged on the shaft 52 of the puller roller 54.

Furthermore, a power supply unit 74 is provided that can be designed both battery-powered and mains-powered.

In connection with the arrangement of the cutting edge 62 or tear-off edge, it must be noted that the latter is arranged on the inside of the housing, so that if anyone reaches into the removal opening 30 contact with the cutting edge 62 is ruled out or at least largely ruled out.

FIG. 3 shows a block diagram of a sensor-controlled motor control unit 76. The motor control unit 76 has a power supply unit 78 with a transformer 80 and a first supply unit 82 for power supply to the sensor 38 and a second supply unit 84 for power supply to the motor 66.

The capacitive sensor 38 comprises the first two-dimensional electrode 40 and the counter-electrode 42 for generation of an electrical field. The sensor 38 is connected to an electronic control unit 88 which is in turn connected to a motor control circuit 90 that receives its energy from the second supply unit 84.

The electronic control unit 88 is furthermore connected to a trimmer 92 used for setting the actuation time of the motor 66, which directly determines the paper length. Furthermore, a switch 94 is provided that permits manual actuation of the motor 66 when the cover 14 is opened to change the paper. Overall, actuation of the motor 66 is only possible when the cover 14 is closed. The closed position of the housing or hood-like cover 14 is picked up by a switch 96.

The motor control 90 directly controls the motor 66, which actuates the issuing device 50 via a transmission having the gears 68, 70. Concerning the operating mode of the motor control unit 76, it must be noted that the approach of a hand changes the electrical field formed between the electrodes 40 and 42, in particular the dielectric constant of the dielectric otherwise formed by air, and that the change is registered by the electronic control unit 88 and processed into a control signal. Depending on the actuation time set using the trimmer 92, the motor 66 is operated for a certain period so that a paper strip of predetermined length is dispensed.

All components of the control circuit 76 are designed with SMD technology. Also, the complete circuit including the electrodes 40, 42 is arranged on a PCB. It must be mentioned that it is particularly advantageous for the PCB 44 and the electrodes 40 and 42 to be arranged inside the housing 12 and hence to be neither visible nor accessible from the outside. Also, the control circuit 76 can be arranged with the electrodes 40, 42 in a separate housing, thus providing additional protection and, in the case of a fault, easy maintenance; for example, in the case of a fault in the electronic circuit the housing has only to be removed and then replaced by a new and correctly functioning unit.

To provide a dispensing preventer to stop repeated operation, an integrated time-lag element is provided, with the time lag also being adjustable using a trimmer. Furthermore, an overcurrent protection circuit is provided so that when the motor is blocked, for example by a paper jam or clogging, the electronic unit is protected against excessive current.

Figure 5:
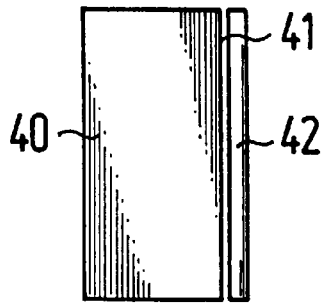
FIG. 5 shows a plan view of electrodes of a capacitive sensor.

As shown in FIG. 5, the electrodes 40, 42 are designed approximately rectangular and have surface ratios of preferably 1:10. For example, one of the electrodes—in the embodiment the electrode 40—can have a surface area of 8 $cm^2$ and the other electrode 42 a surface area of 0.8 $cm^2$. The capacitor formed by the electrodes 40, 42 should then have—when the dielectric is not influenced by a hand for example, i.e. is in the idle state—a capacitance of approximately 1 pF±0.25 pF. If there is then a change in the dielectric, for example by a hand approaching the housing 12 and in particular the sensor field 31, a change in the capacitance results from the change in the dielectric and triggers a switching operation for dispensing a section of towel, in particular a paper towel, pulled off a roll.

As FIG. 5 already makes clear without a detailed description, the electrode 40 is rectangular and the electrode 42 is of strip-like form, said electrodes 40, 42 having a spacing 41 that is narrower than the electrode 42. If a surface of a unit 1 is bounded by the electrodes 40, 42 including the spacing 41, the electrode 40 takes up about 80% of this area, the strip-like spacing 41 about 5% and the strip-like electrode 42 about 15%. As a result the required rectified electrical field extending to the outside of the housing 12 is generated.

By the design of the electrodes 40, 42, in particular of their different sizes and arrangement in a plane running parallel to a housing panel, in particular to the front housing side 20 or to the sensor surface 31, a rectified electrical field extending to the housing exterior is generated and is effective to the required extent for triggering a control command whenever a hand for example moves into the area up to 30 mm from the front side 20 or sensor surface 31, without the need for directly touching the front side 20 or the sensor surface 31.

Figure 4:
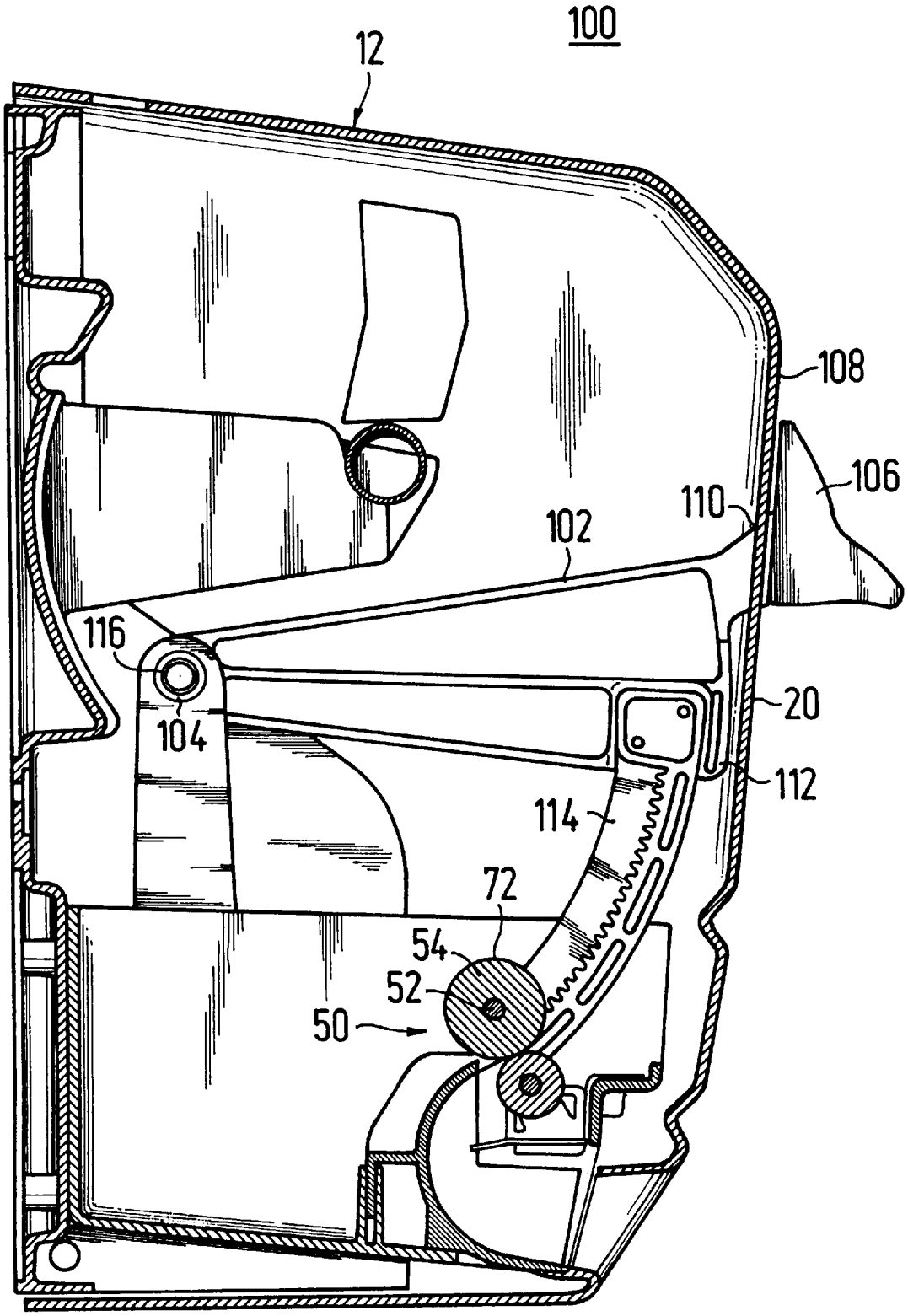
FIG. 4 shows a sectional view of the dispensing device in accordance with FIG. 1 in a mechanical embodiment.

FIG. 4 shows a sectional view of a mechanically actuatable dispensing device 100. It must be noted here that the form of the housing 12 corresponds mainly to the form of the electrically operated dispenser 10. In particular, the same issuing device 50 is used as already described with reference to FIG. 2.

In accordance with the invention, a lever arm 102 is provided for mechanical actuation of the issuing device 50 and is pivotably mounted in the inside of the housing 12 on an axis 104. On the outside of the housing a handle 106 is provided that is connected to the lever arm 102 and is movable substantially parallel to a surface 108 on the front side 20 of the housing 12 for operation of the lever arm 102. For vertical movement of the lever arm 102, a slot-like and substantially vertical opening 110 is provided in the front side 20.

One end 112 of the lever arm 102 opposite the axis 104 is provided with a rack 114 following an arc-shaped path, with the arc-shaped rack 114 interacting with the gear 72 arranged on the shaft 52 and exerting a torque on the puller roller 54 when the lever arm 102 is actuated. The return of the lever arm 102 to its original position is achieved using a spring 116, which is for example designed as a torsion spring and is arranged coaxially to the axis. It is provided here that the gear 72 is designed with sleeve freewheel, so that no torque is transmitted by the freewheel movement to the puller roller 54 in the event of an upward movement of the lever arm or curved rack 114.

With the teachings in accordance with the invention, easy-to-operate and fault-resistant towel dispensers are provided, and the servicing costs are reduced by easy maintenance and the use of only a few elements subject to wear. The design in accordance with the invention also permits simple conversion from mechanically to electrically operating paper dispensers and vice versa.

The housing 12 is preferably made of an impact-resistant and corrosion-resistant plastic whose stability is increased by edging and beading. The provision of an internal sensor in accordance with the invention means than external and fault-prone sensors can be dispensed with.

What is claimed is:

1. A paper towel dispenser (10, 100), comprising:

a housing (12) in which a towel receiver and a towel issuing device (50) are provided, said issuing device being actuatable by a sensor (38) activatable from the housing exterior, wherein the sensor is a capacitive sensor (38) with a first two-dimensional and a second two-dimensional electrode (40, 42) having different surface areas arranged inside the housing (12) and passing along at least one housing side (20).

2. Towel dispenser according to claim 1, wherein the first and the second electrode (40, 42) are coplanar or disposed in two planes that are parallel to the housing front side (20).

3. Towel dispenser according to claim 1, wherein the surfaces areas of the electrodes (40, 42) being in a ratio of approximately 1:5 to 1:20 and wherein the electrodes have a spacing (41) therebetween equal to or less than the width of the second electrode (42).

4. Towel dispenser according to claim 1, wherein the electrodes (40, 42) are arranged directly behind a housing panel and extend at least in some areas parallel or approximately parallel to a sensor field (31) provided in the housing panel, in the area of which an electrical field running between the electrodes can be influenced.

5. Towel dispenser according to claim 1, wherein the sensor (28) is arranged directly behind the housing front side (20).

6. Towel dispenser according to claim 1, wherein the front side (20) has at least one visual element (32, 34) indicating a sensor field (31) or a removal opening (30).

7. Towel dispenser according to claim 6, wherein the visual element on the front side (20) of the housing (12) is designed as at least two recesses (32, 34) running horizontally, the recesses dividing the front side of the housing in the golden section ratio.

8. Towel dispenser according to claim 1, wherein the towel dispenser (10) is battery-operated.

9. Towel dispenser according to claim 1, wherein the towel dispenser (10) has a switch (94) on the inside of the housing with which the issuing device (50) can be operated when the housing is open.

10. Towel dispenser according to claim 1 with a tear-off device extending from the housing interior in the area of the issuing device (50), wherein the tear-off device (62) is not accessible from the housing exterior and wherein the tear-off device comprises a Z-shaped angular section extending parallel to a rotary axis of a paper roll and wherein the tear-off device includes a free longitudinal edge with teeth of differing length.

11. Towel dispenser according to claim 1, comprising a cover having an upper side angled about 8° from the horizontal.

12. Towel dispenser according to claim 1, including first and second side panels (24, 26) having vision windows (38).

13. Towel dispenser according to claim 11, wherein the hood-like cover (14) is rotatably fastened to and lockable to a rear panel (16).

14. Towel dispenser according to claim 1, wherein the capacitive sensor (38) has an adjustable sensitivity.

15. Towel dispenser according to claim 1, wherein upon actuation the issuing device (50) issues paper towels for an adjustable period of time.

* * * * *